US009645539B2

(12) United States Patent
Kanai et al.

(10) Patent No.: US 9,645,539 B2
(45) Date of Patent: May 9, 2017

(54) DECURLER AND IMAGE FORMING APPARATUS

(71) Applicant: FUJI XEROX CO., LTD., Tokyo (JP)

(72) Inventors: Kenji Kanai, Kanagawa (JP); Shinichi Aizawa, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/852,783

(22) Filed: Sep. 14, 2015

(65) Prior Publication Data

US 2016/0282793 A1 Sep. 29, 2016

(30) Foreign Application Priority Data

Mar. 25, 2015 (JP) ..... 2015-063382

(51) Int. Cl.
*G03G 15/00* (2006.01)

(52) U.S. Cl.
CPC ..... *G03G 15/6576* (2013.01)

(58) Field of Classification Search
CPC ..... G03G 2215/00662
USPC ..... 399/406
See application file for complete search history.

(56) References Cited

U.S. PATENT DOCUMENTS 5,565,971 A * 10/1996 Kuo ..... B65H 29/12 162/197
5,666,624 A * 9/1997 Kanesawa ..... G03G 15/206 219/216
6,965,750 B2 * 11/2005 Muratani ..... G03G 15/6576 271/188
7,167,670 B2 * 1/2007 Obata ..... G03G 15/2064 219/216
7,298,981 B2 * 11/2007 Oohara ..... G03G 15/2028 399/322
8,447,220 B2 * 5/2013 Yamaguchi ..... G03G 15/2064 399/122
8,905,612 B2 12/2014 Sawayanagi
2005/0141932 A1 * 6/2005 Sugiyama ..... G03G 15/2064 399/328
2005/0185996 A1 * 8/2005 Oishi ..... G03G 15/206 399/329
2005/0219814 A1 * 10/2005 Yazawa ..... H05K 7/20445 361/692
2006/0257180 A1 * 11/2006 Nakagawa ..... G03G 15/206 399/329
2007/0048044 A1 * 3/2007 Tokuhiro ..... G03G 15/206 399/329
2007/0172278 A1 * 7/2007 Yamamoto ..... G03G 15/6576 399/405
(Continued)

FOREIGN PATENT DOCUMENTS

JP 2012-178230 A 9/2012
JP 2014-035523 A 2/2014

*Primary Examiner* — Anthony Nguyen
(74) *Attorney, Agent, or Firm* — Sughrue Mion, PLLC

(57) ABSTRACT

A decurler includes an endless decurling belt that is disposed so as to face an image surface of a recording medium to which an image has been thermally fixed, a decurling roller that contacts the decurling belt so as to form a decurling region between the decurling roller and the decurling belt, and a support member that is made of a thermally conductive synthetic resin having a thermal conductivity of 1 (W/mK) or higher and that directly or indirectly contacts the decurling belt.

5 Claims, 7 Drawing Sheets

(56) References Cited

U.S. PATENT DOCUMENTS

| | | | | |
|---|---|---|---|---|
| 2008/0240806 | A1* | 10/2008 | Lee | G03G 15/2064 399/328 |
| 2008/0273904 | A1* | 11/2008 | Nishida | G03G 15/2064 399/333 |
| 2009/0214278 | A1* | 8/2009 | Kawachi | B65H 29/52 399/397 |
| 2010/0189447 | A1* | 7/2010 | Ishizuka | G03G 15/6573 399/15 |
| 2011/0318030 | A1* | 12/2011 | Ogawahara | G03G 15/206 399/45 |
| 2012/0121304 | A1* | 5/2012 | Tokuda | G03G 15/2039 399/329 |
| 2012/0328345 | A1* | 12/2012 | Kunii | G03G 15/6585 399/341 |

* cited by examiner

FIG. 7

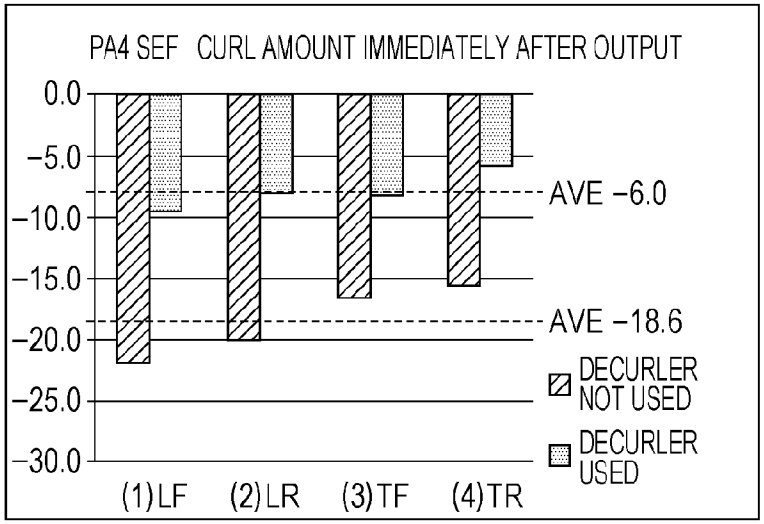

FOR THIN SHEET DOWNWARDLY CURLED, AVERAGE CURL AMOUNT IS −6.0 mm WHEN DECURLER IS USED, WHILE AVERAGE CURL AMOUNT IS −18.6 mm WHEN DECURLER IS NOT USED, WHICH SHOWS THAT DECURLER HAS DECURLING EFFECT.

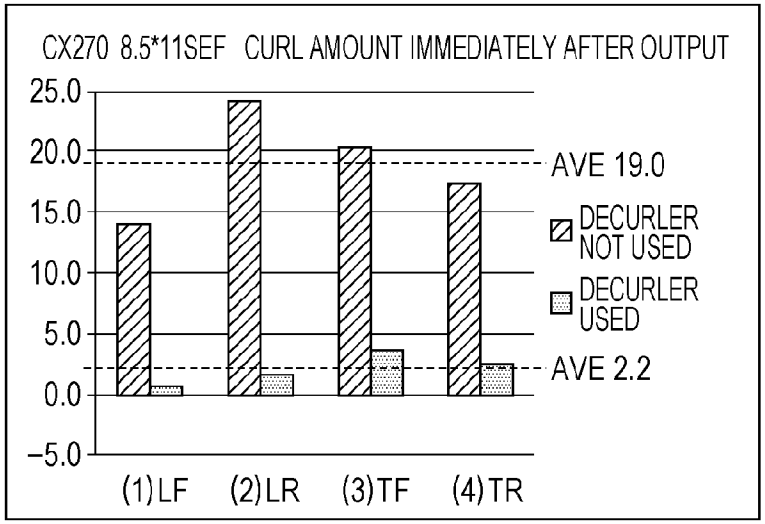

FOR THICK SHEET UPWARDLY CURLED, AVERAGE CURL AMOUNT IS 2.2 mm WHEN DECURLER IS USED, WHILE AVERAGE CURL AMOUNT IS 19 mm WHEN DECURLER IS NOT USED, WHICH SHOWS THAT DECURLER HAS DECURLING EFFECT.

DECURLER AND IMAGE FORMING APPARATUS

CROSS-REFERENCE TO RELATED APPLICATIONS

This application is based on and claims priority under 35 USC 119 from Japanese Patent Application No. 2015-063382 filed Mar. 25, 2015.

BACKGROUND

Technical Field

The present invention relates to a decurler and an image forming apparatus.

SUMMARY

According to an aspect of the invention, a decurler includes an endless decurling belt that is disposed so as to face an image surface of a recording medium to which an image has been thermally fixed, a decurling roller that contacts the decurling belt so as to form a decurling region between the decurling roller and the decurling belt, and a support member that is made of a thermally conductive synthetic resin having a thermal conductivity of 1 (W/mK) or higher and that directly or indirectly contacts the decurling belt.

BRIEF DESCRIPTION OF THE DRAWINGS

An exemplary embodiment of the present invention will be described in detail based on the following figures, wherein:

FIG. 7 shows graphs representing the results of Example; and

DETAILED DESCRIPTION

Hereinafter, an exemplary embodiment of the present invention will be described with reference to the drawings.

Figure 1:
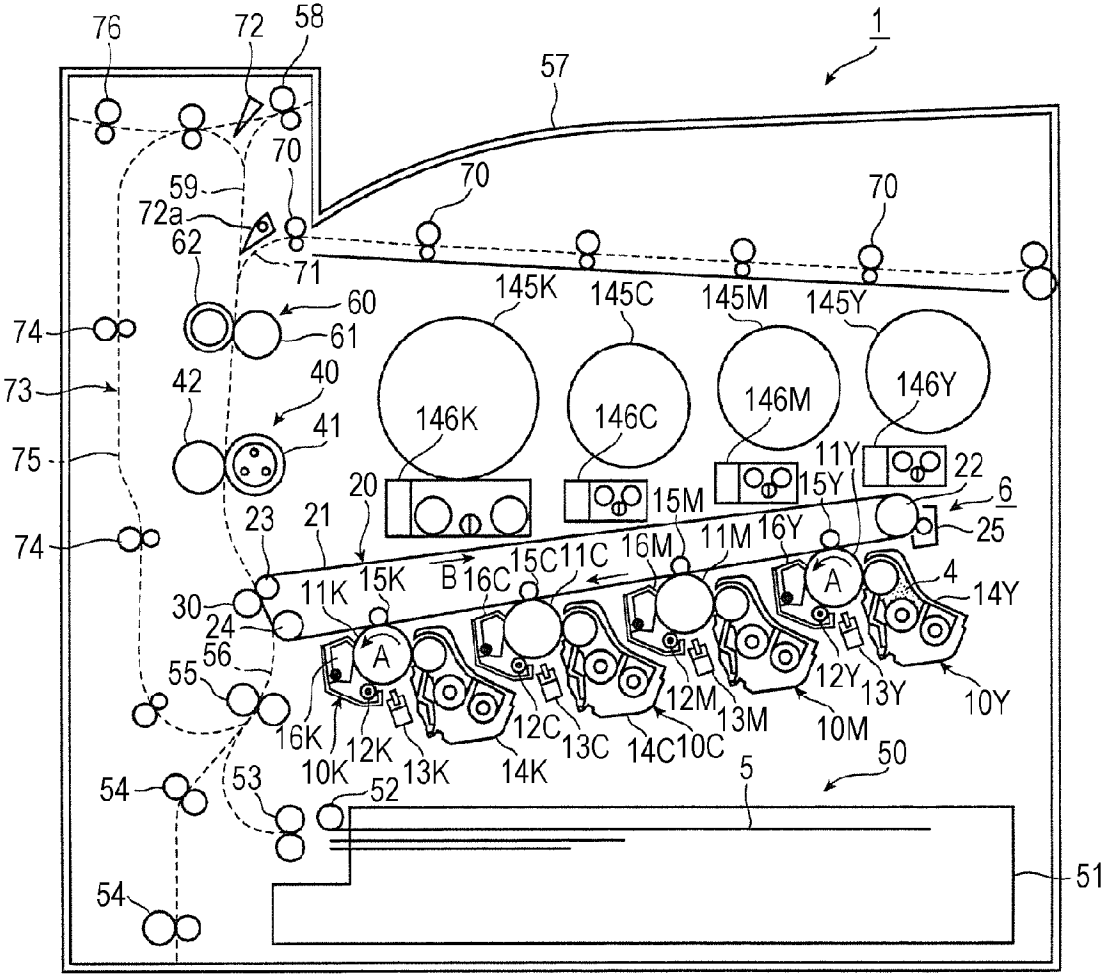
FIG. 1 is an overall view illustrating an image forming apparatus including a decurler according to the exemplary embodiment of the present invention.

FIG. 1 is an overall view illustrating an image forming apparatus including a decurler according to the present exemplary embodiment of the present invention.

Overall Structure of Image Forming Apparatus

An image forming apparatus 1 according to the present exemplary embodiment is structured as, for example, a color printer. The image forming apparatus 1 includes plural image forming devices 10, an intermediate transfer device 20, a sheet feeder 50, a fixing device 40, and a decurler 60. The image forming devices 10 form toner images by using toners included in developers 4. The intermediate transfer device 20 carries toner images formed by the image forming devices 10 and transports the toner images to a second-transfer position at which the toner images are second-transferred to a recording sheet 5, which is an example of a recording medium. The sheet feeder 50 holds the recording sheets 5 to be supplied to the second-transfer position in the intermediate transfer device 20 and transports the recording sheet 5. The fixing device 40 fixes the toner images on the recording sheet 5, which have been second-transferred by the intermediate transfer device 20. The image forming devices 10 and the intermediate transfer device 20 constitute an image forming unit 6, which is an example of an image forming unit and which forms an image on the recording sheet 5. Referring to FIG. 1, a body 1*a* of the image forming apparatus 1 includes a supporting structural member, an outer cover, and the like.

The image forming devices 10 include four image forming devices 10Y, 10M, 10C, and 10K, which respectively form yellow (Y), magenta (M), cyan (C), and black (K) toner images. The four image forming devices 10 (Y, M, C, and K) are arranged in a row so as to be inclined in the inner space of the body 1*a*.

As illustrated in FIG. 1, each of the image forming devices 10 (Y, M, C, and K) includes a photoconductor drum 11, which is an example of an image carrier and which rotates. Each of the image forming devices 10 (Y, M, C, and K) further includes the following devices around the photoconductor drum 11, which are examples of a toner image forming unit: a charger 12, an exposure device 13, a developing device 14 (Y, M, C, or K), a first-transfer device 15 (Y, M, C, or K), and a drum cleaner 16 (Y, M, C, or K). The charger 12 charges the outer peripheral surface (image carrying surface) of the photoconductor drum 11, on which an image is to be formed, to a required potential. The exposure device 13 forms an electrostatic latent image (for a corresponding color) having a potential difference by exposing the peripheral surface of the photoconductor drum 11 with light that is modulated based on image information (signal). The developing device 14 develops the electrostatic latent image into a toner image by developing the electrostatic latent image by using the developer 4 of a corresponding color. The first-transfer device 15 transfers the toner image to the intermediate transfer device 20. The drum cleaner 16 cleans the photoconductor drum 11 after the first-transfer by removing adherents, such as toner, adhering to the image carrying surface.

The photoconductor drum 11 includes a hollow or solid cylindrical body that is grounded. A photoconductive layer (photosensitive layer) made of a photoconductive material, which serves as an image carrying surface, is formed on the peripheral surface of the body. The photoconductor drum 11 is supported so that a driving force is transmitted from a rotary driving unit (not shown) and the photoconductor drum 11 is rotated in the direction indicated by an arrow A.

The charger 12 includes a contact charging roller that is disposed so as to be in contact with the photoconductor drum 11. A charging voltage is applied to the charger 12. In a case where the developing device 14 performs reversal development, as the charging voltage, a voltage or a current having a polarity the same as the charge polarity of toner supplied from the developing device 14 is applied. Alternatively, a non-contact charger, such as a scorotron, which is disposed in a state in which the charger is not in contact with the photoconductor drum 11, may be used as the charger 12.

The exposure device 13 forms an electrostatic latent image by irradiating the charged peripheral surface of the photoconductor drum 11 with light that is modulated in accordance with image information input to the image forming apparatus 1. When forming a latent image, image information (signal), which has been input to the image forming apparatus 1 in any way, is sent to the exposure device 13.

The exposure device 13 includes an LED print head in which plural light emitting diodes (LEDs), which are light emitting elements, are arranged in the axial direction of the photoconductor drum 11. The LED print head forms an electrostatic latent image by irradiating the photoconductor drum 11 with light that is emitted from the LEDs and that is modulated in accordance with the image information. Alternatively, a device that deflectively scan a laser beam that is modulated in accordance with image information in the axial direction of the photoconductor drum 11 may be used as the exposure device 13.

Each of the developing device 14 (Y, M, C, and K) includes a development roller, an agitation transport member, and a thickness regulation member. The development roller has a housing, in which an opening and a developer containing chamber are formed, holds the developer, and transports the developer to a development region at which the development roller faces the photoconductor drum 11. The agitation transport member, which includes two screw augers, transports the developer through the development roller while agitating the developer. The thickness regulation member regulates the amount (layer thickness) of the developer held on the development roller. A developing voltage is applied from a power supply (not shown) across the development roller and the photoconductor drum 11 of the developing device 14. The development roller and the agitation transport member are rotated in required directions by receiving a driving force from a rotary driving device (not shown). As the four color developers 4 (Y, M, C, and K), two-component developers, each including a nonmagnetic toner and a magnetic carrier, are used.

The first-transfer devices 15 (Y, M, C, and K) are contact-transfer devices each including a first-transfer roller that contacts the outer periphery of the photoconductor drum 11 with an intermediate transfer belt 21 therebetween and that rotates. A first-transfer voltage is applied to the first-transfer roller. As the first-transfer voltage, a direct-current voltage having a polarity opposite to the charge polarity of the toner, is supplied from a power supply (not shown).

The drum cleaner 16 includes a body, a cleaning plate, and a feed-out member. The body is a container having an opening in a part thereof. The cleaning plate, which is disposed so as to contact the peripheral surface of the photoconductor drum 11 after the first-transfer with a required pressure, cleans the photoconductor drum 11 by removing adherents, such as residual toner. The feed-out member, which is a screw auger or the like, recovers the adherents, such as toner, removed by the cleaning plate, and transports the adherents so as to feed out the adherents to a recovery system (not shown). As the cleaning plate, a plate-shaped member (such as a blade) made of a material such as rubber is used.

As illustrated in FIG. 1, the intermediate transfer device 20 is disposed above the image forming devices 10 (Y, M, C, and K). The intermediate transfer device 20 includes the intermediate transfer belt 21, plural belt support rollers 22 to 24, a second-transfer device 30, and a belt cleaner 25. The intermediate transfer belt 21 rotates in the direction indicated by an arrow while passing through first-transfer positions between the photoconductor drums 11 and the first-transfer devices 15 (first-transfer rollers). The belt support rollers 22 to 24 hold the intermediate transfer belt 21 from the inside of the intermediate transfer belt 21 in a desired state and rotatably support the intermediate transfer belt 21. The second-transfer device 30, which is an example of a second-transfer member, is disposed so as to face the outer peripheral surface (image holding surface) of the intermediate transfer belt 21 supported by a belt support roller 23. The second-transfer device 30 second-transfers the toner image on the intermediate transfer belt 21 to the recording sheet 5. The belt cleaner 25 cleans the intermediate transfer belt 21 after passing through the second-transfer device 30 by removing adherents, such as toner and paper dust, adhering the outer peripheral surface of the intermediate transfer belt 21.

As the intermediate transfer belt 21, for example, an endless belt made of a material in which a resistance adjusting agent, such as carbon black, is dispersed in a synthetic resin, such as polyimide resin or polyamide resin, is used. The belt support roller 22 is a driving roller that is rotated by a driving device (not shown). The belt support roller 23 is a second-transfer backup roller. The belt support roller 24 is a tension roller for applying a tension to the intermediate transfer belt 21.

The second-transfer device 30 is a contact-transfer device including a second-transfer roller. The second-transfer roller rotates while being in contact with the peripheral surface of the intermediate transfer belt 21 at the second-transfer position in the intermediate transfer device 20, which is located on a part the outer peripheral surface of the intermediate transfer belt 21 supported by the belt support roller 23. A second-transfer voltage is applied to the second-transfer roller. A direct-current voltage having a polarity opposite to or the same as the charge polarity of the toner is applied, as the second-transfer voltage, to the second-transfer device 30 or the belt support roller 23 of the intermediate transfer device 20.

The belt cleaner 25 cleans the intermediate transfer belt 21 by removing adherents, such as residual toner, by removing the adherents from the peripheral surface of the intermediate transfer belt 21 after the second-transfer.

The fixing device 40 includes a heating roller 41 and a pressing belt 42. The heating roller 41 is heated so that the surface temperature thereof is maintained at a required temperature. The pressing belt 42, which is an endless belt and which is an example of a pressing member, rotates while being in pressed-contact with the heating roller 41 substantially along the axis the heating roller 41 with a predetermined pressure. In the fixing device 40, a contact region in which the heating roller 41 and the pressing belt 42 are in contact with each other is a fixing region in which a required fixing operation (heating and pressing) is performed. The structure of the fixing device 40 will be described below in detail.

The decurler 60 according to the present exemplary embodiment of the invention is disposed above the fixing device 40 in the vertical direction. The decurler 60 removes curl from the recording sheet 5 to which a toner image has been fixed by the fixing device 40. The decurler 60 includes an endless decurling belt 61 and a decurling roller 62, which are in contact (pressed-contact) with each other. The structure of the decurler 60 will be described below in detail.

The sheet feeder 50 is disposed below the image forming devices 10 (Y, M, C, and K) for yellow (Y), magenta (M), cyan (C), and black (K). The sheet feeder 50 includes one (or more) sheet container 51 and feeding devices 52 and 53. The sheet container 51 contains a stack of recording sheets 5 that have a desired size and that are of a desired type. The feeding devices 52 and 53 feed the recording sheets 5 one by one from the sheet container 51. The sheet container 51 is, for example, removable in a direction toward the front surface of the body 1*a* (a side surface of the body 1*a* that a user faces when operating the image forming apparatus 1).

Examples of the recording sheet 5 include a plain paper sheet for an electrophotographic copier or printer and an OHP sheet. The smoother the surface of the recording sheet 5, the smoother the surface of an image after having been fixed. For example, a coated paper sheet, which is made by coating the surface of a plain paper sheet with a resin or the like, or a so-called thick sheet having a comparatively large basis weight, such as art paper sheet for printing, may be used as the recording sheet 5.

A sheet transport path 56 is disposed between the sheet feeder 50 and the second-transfer device 30. The sheet transport path 56 includes one (or more) sheet transport roller pair 54, one (or more) sheet transport roller pair 55, and a transport guide (not shown). The sheet transport roller pairs 54 and 55 transport the recording sheet 5, fed from the sheet feeder 50, to the second-transfer position. The sheet transport roller pair 54 is structured as, for example, a roller that adjusts the timing for transporting the recording sheet 5 (registration roller). A first output transport path 59 and a second output transport path 71 are formed near a sheet output opening, which is formed in the image forming apparatus body 1*a*. The first output transport path 59, which is curved, is used to output the recording sheet 5 after fixing, which is fed out from the fixing device 40, through a sheet output roller pair 58 to a sheet output unit 57. The sheet output unit 57 is disposed in an upper part of the body 1*a*. The second output transport path 71 has a sheet transport roller pair 70 for outputting the recording sheet 5 to a post-processing device (not shown).

A first switching gate 72 and a second switching gate 72*a*, for switching a sheet transport path, are disposed between the fixing device 40 and the sheet output roller pair 58. The rotation direction of the sheet output roller pair 58 is allowed to be changed between a forward direction (output direction) and a backward direction. When forming images on both sides of the recording sheet 5, after the trailing end the recording sheet 5 having an image formed on one surface thereof has passed through the first switching gate 72, the rotation direction of the sheet output roller pair 58 is changed from the forward direction (output direction) to the reverse direction. The transport path of the recording sheet 5, which is transported by the sheet output roller pair 58 in the reverse direction, is switched by the first switching gate 72, and the recording sheet 5 is transported to a duplex transport unit 73, which is an example of a duplex transport unit. The duplex transport unit 73 is disposed so as to extend substantially in the vertical direction. The duplex transport unit 73 includes a sheet transport roller pair 74 and a duplex transport path 75. The sheet transport roller pair 74 transports the recording sheet 5 to the sheet transport roller pair 55 in a state in which the recording sheet 5 is flipped. The duplex transport path 75 includes a transport guide (not shown) and the like. When transporting the recording sheet to the second output transport path 71, the second switching gate 72*a* switches the transport path.

Referring to FIG. 1, a sheet output roller pair 76 outputs the recording sheet 5 to a face-up tray (not shown).

Referring to FIG. 1, plural toner cartridges 145 (Y, M, C, and K) are arranged so as to each extend in the direction perpendicular to the plane of figure. The toner cartridges 145, which are examples of a developer container, each contain a developer that at least includes toner and that is to be supplied to the corresponding developing devices 14 (Y, M, C, and K). Toner supply devices 146 (Y, M, C, and K) supply toners to the corresponding developing devices 14 (Y, M, C, and K).

Structure of Fixing Device

Figure 2:
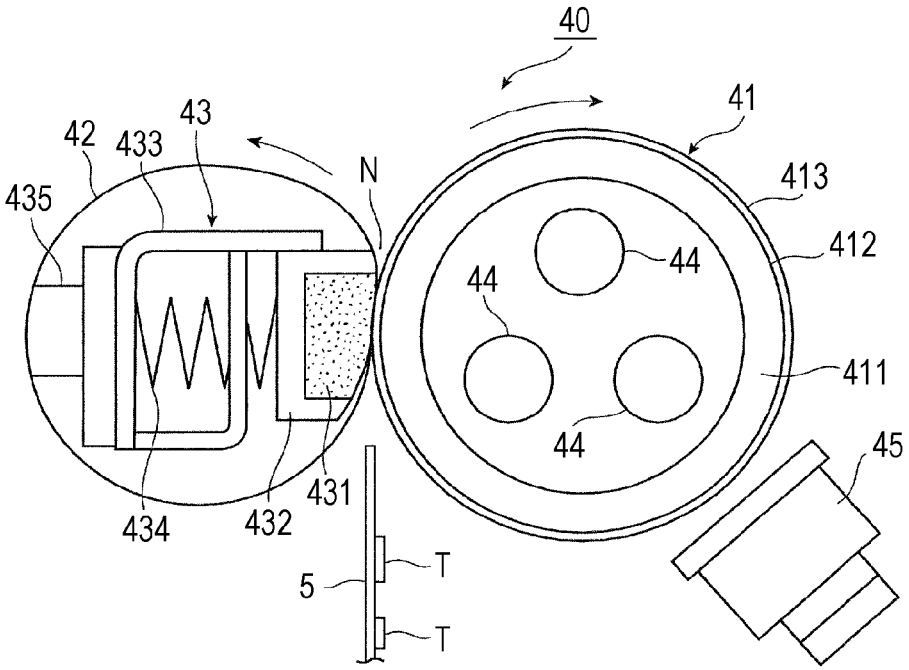
FIG. 2 is a schematic sectional view illustrating a fixing device.

FIG. 2 is a schematic sectional view illustrating the fixing device 40 included in the image forming apparatus 1.

As illustrated in FIG. 2, the fixing device 40 includes the heating roller 41, the pressing belt 42, a pressing member 43, and a heat source 44. The heating roller 41, which is an example of a heating rotary member, fixes an unfixed toner image T on the recording sheet 5 by heating the toner image T. The pressing belt 42, which is an endless belt and which is an example of a pressing rotary member, presses the recording sheet 5 against the heating roller 41. The pressing member 43 presses the pressing belt 42 from the inner periphery of the pressing belt 42 toward the heating roller 41. The heat source 44 is disposed inside the heating roller 41 and includes one (or more) halogen heater for heating the heating roller 41. In the fixing device 40, a contact region in which the heating roller 41 and the pressing belt 42 are in contact (pressed-contact) with each other is a fixing region N (nip region) in which a fixing operation of heating and pressing the recording sheet 5 is performed.

The heating roller 41 includes a cylindrical metal core 411, a heat-resistant elastic layer 412, and a release layer 413. The metal core 411 is made of a metal, such as stainless steel, aluminum, or steel. The elastic layer 412, which is made of silicone rubber or the like and is heat-resistant, covers the surface of the metal core 411 with a predetermined thickness (for example, about 5 mm). The release layer 413, which is made of a material having high releasability, such as tetrafluoroethylene perfluoroalkylvinylether polymer (PFA) tube, covers the surface of the elastic layer 412 with a thickness of, for example, about 50 μm. The heating roller 41 has, for example, a hollow cylinder having an outside diameter of about 30 mm. The length of the heating roller 41 in the axial direction (longitudinal direction) is greater than the maximum width of the recording sheet 5 and is, for example, 320 mm. The heating roller 41 is rotated by a driving unit (not shown) in the direction indicated by an arrow.

The pressing belt 42 is pressed by the pressing member 43, which is disposed inside the pressing belt 42, against the surface of the heating roller 41 with a predetermined pressing force. The pressing member 43 includes a pressing pad 431, a holding member 432, a support member 433, and a coil spring 434. The pressing pad 431 is in pressed-contact with the surface of the heating roller 41 with the pressing belt 42 therebetween. The holding member 432 holds the pressing pad 431. The support member 433 supports the holding member 432. The coil spring 434 presses the pressing pad 431 against the heating roller 41. The surface of the pressing pad 431 is covered with a sheet-shaped low-friction member (not shown) to reduce friction between the pressing pad 431 and the pressing belt 42. A felt member 435, which is a liquid lubricant supply member, is disposed on the inner surface of the pressing belt 42.

The pressing belt 42 is an endless belt that is made of a synthetic resin, such as polyimide resin, and that has an outside diameter of 30 mm and a thickness of 75 μm. As necessary, a release layer made of PFA or the like may be formed on the surface of the pressing belt 42. Referring to FIG. 2, a temperature sensor 45 detects the surface temperature of the heating roller 41.

Operation of Image Forming Apparatus

Hereinafter, an image forming operation performed by the image forming apparatus 1 will be described.

In this operation, a full-color image is formed by combining four color toner images (Y, M, C, and K) by using the four image forming devices 10 (Y, M, C, and K).

When the image forming apparatus 1 receives instruction for performing an image forming operation (printing operation), the four image forming devices 10 (Y, M, C, and K), the intermediate transfer device 20, the second-transfer device 30, the fixing device 40, and the like start operating.

In the image forming devices 10 (Y, M, C, and K), first, the photoconductor drums 11 rotate in the direction indicated by arrows A, the chargers 12 charge the surfaces of the photoconductor drums 11 so that the surfaces have a potential having a required polarity (in the present exemplary embodiment, negative polarity). Next, the exposure devices 13 irradiate the surfaces of the charged photoconductor drums 11 with light that is modulated on the basis of image signals, which are obtained by converting the image information input to the image forming apparatus 1 into color components (Y, M, C, and K), thereby forming electrostatic latent images corresponding to the color components and having a required potential difference.

Next, the image forming devices 10 (Y, M, C, and K) supply color toners (Y, M, C, and K), which have been charged so as to have a required polarity (negative polarity), from the development rollers to corresponding electrostatic latent images for the color components, which have been formed on the photoconductor drum 11, thereby performing development. Due to the development, electrostatic latent images for the color components formed on the photoconductor drums 11 are made visible as four color toner images developed by using toners of corresponding colors.

Next, when the color toner images formed on the photoconductor drums 11 of the image forming devices 10 (Y, M, C, and K) are transported to the first-transfer positions, the first-transfer devices 15 successively first-transfer the color toner images so as to be successively superposed on the intermediate transfer belt 21 of the intermediate transfer device 20, which rotate in the direction indicated by the arrow.

After the first-transfer has been finished, in the image forming devices 10, the drum cleaners 16 clean the surfaces of the photoconductor drums 11 by scraping and removing adherents from the surfaces. Thus, the image forming devices 10 become ready for performing the next image forming operation.

Next, in the intermediate transfer device 20, the toner images, which have been first-transferred to the intermediate transfer belt 21, are transported to the second-transfer position as the intermediate transfer belt 21 rotates. The sheet feeder 50 feeds a required recording sheet 5 to the sheet transport path 56 in synchronism with the image forming operation. In the sheet transport path 56, the sheet transport roller pair 55, which is a registration roller, feeds the recording sheet 5 to the second-transfer position so as to be in time for the second-transfer.

At the second-transfer position, the second-transfer roller of the second-transfer device 30 simultaneously second-transfers the toner images on the intermediate transfer belt 21 to the recording sheet 5. After the second-transfer has been finished, in the intermediate transfer device 20, the belt cleaner 25 cleans the intermediate transfer belt 21 by removing adherents, such as toner, that remain on the intermediate transfer belt 21 after the second-transfer.

Next, the recording sheet 5, to which the toner images have been second-transferred, is peeled off the intermediate transfer belt 21 and the second-transfer device 30 and transported to the fixing device 40. In the fixing device 40, while the recording sheet 5 after the second-transfer is guided into and passes through the contact region between the heating roller 41 and the pressing belt 42 that rotate, necessary fixing operations (heating and pressing) are performed so that unfixed toner images are fixed to the recording sheet 5. Then, the decurler 60 removes curl from the recording sheet 5, to which the toner images have been fixed, as described below. Lastly, if the image forming operation is an operation in which an image is formed on only one surface of the recording sheet 5, the sheet output roller pair 58 outputs the recording sheet 5 to, for example, the sheet output unit 57 disposed in an upper part of the body 1*a*.

Through the operation described above, a full color image composed of four color toner images is formed on the recording sheet 5 and the recording sheet 5 is output.

Structure of Decurler

Figure 3:
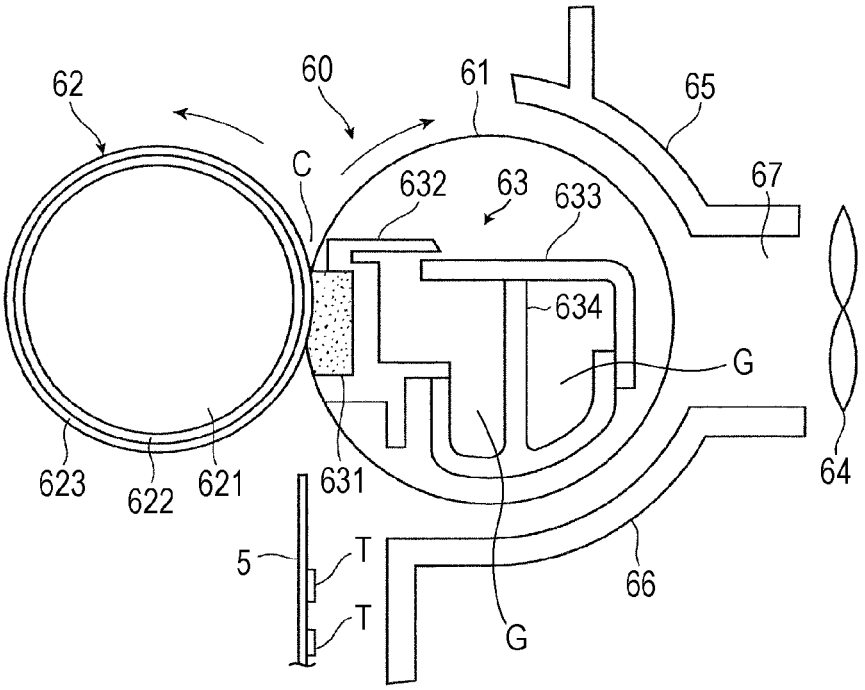
FIG. 3 is a schematic sectional view illustrating the decurler according to the exemplary embodiment of the present invention.

FIG. 3 is a schematic view illustrating the decurler according to the present exemplary embodiment.

As illustrated in FIG. 3, the decurler 60 includes the decurling belt 61, the decurling roller 62, and a pressing member 63. The decurling belt 61 is an endless belt that is disposed so as to face an image surface of the recording sheet 5 to which a toner image (image) T has been fixed. The decurling roller 62 is disposed so as to face a surface of the recording sheet 5 on which an image is not formed. The pressing member 63 presses the decurling belt 61 from the inner periphery of the decurling belt 61 toward the decurling roller 62. In the decurler 60, a region in which the decurling belt 61 and the decurling roller 62 are in contact (pressed-contact) with each other is a decurling region C for removing curl from the recording sheet 5.

The arrangement of the decurling belt 61, which is an endless belt, and the decurling roller 62, which is a roller, in the decurler 60 is opposite to the arrangement of an endless belt and a roller in the fixing device 40. Namely, in the decurler 60, the decurling belt 61 is disposed so as to face an image surface of the recording sheet 5 to which the toner image T has been fixed, and the decurling roller 62 is disposed so as to face a surface of the recording sheet 5 on which an image is not formed.

Depending on conditions, such as the structure of the fixing device 40, the material of the recording sheet 5, and the state of the toner image T on the recording sheet 5, curl may be generated in the recording sheet 5 so that the recording sheet 5 is concavely deformed toward the heating roller 41 of the fixing device 40 (for convenience, referred to as "upward curl") or curl may be generated in the recording sheet 5 so that the recording sheet 5 is concavely deformed toward the pressing belt 42 of the fixing device 40 (for convenience, referred to as "downward curl"). By structuring the decurler 60 as described above, the decurler 60 is capable of removing both the upward curl and the downward curl.

To be more specific, in some cases, upward curl may be generated in the recording sheet 5, that is, the recording sheet 5 may become deformed convexly toward the heating roller 41 when the recording sheet 5 passes through the fixing device 40 in which the heating roller 41 is disposed so as to face an image surface of the recording sheet 5 on which the toner image T has been formed and the pressing belt 42 is disposed so as to face a surface the recording sheet 5 on which an image is not formed. In such cases, when the recording sheet 5 passes through the decurler 60, in which the decurling belt 61 is disposed so as to face the image surface of the recording sheet 5 to which the toner image T has been fixed and the decurling roller 62 is disposed on the surface of the recording sheet 5 on which an image is not formed, downward curl tends to be generated in the recording sheet 5, that is, the recording sheet 5 tends to become deformed convexly toward the decurling roller 62. Therefore, the upward curl, which has been generated in the recording sheet 5 due to heat and pressure applied to the recording sheet 5 by the fixing device 40, is offset by the downward curl that is generated when the recording sheet 5 passes through the decurler 60, which is disposed adjacent to the fixing device 40. As a result, curl generated in the recording sheet 5 is removed.

The decurling belt 61 is made from a thin flexible sheet. Before the decurling belt 61 becomes deformed by being pressed against the decurling roller 62, the decurling belt 61 has a thin-walled cylindrical shape having an outside diameter in the range of about 20 to 50 mm. In the present exemplary embodiment, the decurling belt 61 has an outside diameter of about 30 mm, which is the same as that of the heating roller 41. The decurling belt 61 is made of, for example, a heat-resistant synthetic resin, such as polyimide resin.

The decurling belt 61 may be formed as a single layer that is a base layer made of polyimide resin or the like. However, the decurling belt 61 may have, on the surface thereof, a surface release layer that is made of tetrafluoroethylene perfluoroalkylvinylether polymer (PFA), polytetrafluoroethylene (PTFE), or silicone copolymer; or a composite layer made of such materials.

The decurling belt 61 is pressed against the surface of the decurling roller 62 by the pressing member 63, which is disposed inside the decurling belt 61, with a predetermined pressing force. The pressing member 63 includes a pressing pad 631, a holding member 632, and support members 633 and 634. The pressing pad 631 is in pressed-contact with the surface of the decurling roller 62 with the decurling belt 61 therebetween. The holding member 632 holds the pressing pad 631. The support members 633 and 634 support the holding member 632. The holding member 632 is disposed so that the holding member 632 directly contacts the decurling belt 61 at a position upstream of the decurling region C in the direction in which the decurling belt 61 rotates. The support members 633 and 634 indirectly contact the decurling belt 61 with the holding member 632 therebetween. As necessary, the surface of the pressing pad 631 is covered with a sheet-shaped low-friction member (not shown) to reduce friction between the pressing pad 631 and the decurling belt 61. A felt member (not shown), which is a liquid-lubricant supply member, is disposed on the inner surface of the decurling belt 61.

The pressing pad 631 is made of, for example, an elastic material, such as silicone rubber or fluorocarbon rubber. However, the material of the pressing pad 631 is not limited to such a material. A resin material that is heat-resistant and that has low thermal conductivity, such as polyimide resin, polyamide resin, phenol resin, polyether sulfone (PES), polyphenylene sulfide (PPS), or liquid crystal polymer (LCP), may be used. In the present exemplary embodiment, a heat-resistant elastic material, such as silicone rubber or fluorocarbon rubber, is used as the material of the pressing pad 631.

On the other hand, the holding member 632 and at least one of the support members 633 and 634 are made of a thermally conductive synthetic resin having a thermal conductivity of 1 (W/mK) or higher. In the present exemplary embodiment, the holding member 632 and both of the support members 633 and 634 are made of a thermally conductive synthetic resin having a thermal conductivity of 1 (W/mK) or higher. Examples of a thermally conductive synthetic resin having a thermal conductivity of 1 (W/mK) or higher, which is the material of the holding member 632 and the support members 633 and 634, include thermally conductive rigid resins made by DuPont, such as Crastin (registered trademark) FR1330TC BK350, Crastin (registered trademark) FR2000TC WT001, and Zytel (registered trademark) HTN FR-TC.

Crastin (registered trademark) FR1330TC BK350, which is a thermally conductive rigid resin made by DuPont, is a non-insulating thermally conductive resin having low flammability and high toughness and is suitable for injection molding. Crastin (registered trademark) FR1330TC BK350 has a thermal conductivity of 15 W/mK, which is very high.

Crastin (registered trademark) FR2000TC WT001, which is a thermally conductive rigid resin made by DuPont, is an insulating thermally conductive resin having low flammability, high toughness, and high welding strength; and is suitable for injection molding. Crastin (registered trademark) FR2000TC WT001 has a thermal conductivity of 3 W/mK, which is lower than that of FR1330TC BK350 but is higher than that of glass (1 W/mK).

Zytel (registered trademark) HTN FR-TC, which is a thermally conductive rigid resin made by DuPont, is an insulating thermally conductive heat-resistant nylon, and is suitable for extrusion and injection molding. Zytel (registered trademark) HTN FR-TC has a thermal conductivity of 3 W/mK, which is approximately the same as that of Crastin (registered trademark) FR2000TC WT001.

In the present exemplary embodiment, the holding member 632 and the support members 633 and 634 are made of Crastin (registered trademark) FR1330TC BK350, which is a thermally conductive rigid resin made by DuPont.

As illustrated in FIG. 3, the support members 633 and 634 have gaps G so that air flows through the inside thereof.

The decurling roller 62 includes a metal core 621, a heat-resistant elastic layer 622, and a release layer 623. The metal core 621 has a solid or hollow cylindrical shape and is made of a metal, such as stainless steel, aluminum, or steel. The elastic layer 622 has a predetermined thickness (for example, about 5 mm), is made of silicone rubber or the like, and covers the surface of the metal core 621. The release layer 623 is a tube made of tetrafluoroethylene perfluoroalkylvinylether polymer (PFA) or the like, and has a thickness of, for example, about 50 μm. The release layer 623 has high releasability and covers the surface of the elastic layer 622. The decurling roller 62 has, for example, a solid cylindrical shape having an outside diameter of about 30 mm. The length of the decurling roller 62 in the axial direction (longitudinal direction) is larger than the maximum width of the recording sheet 5 and is, for example, 320 mm. The decurling roller 62 is rotated by a driving unit (not shown) in the direction indicated by an arrow.

Figure 4:
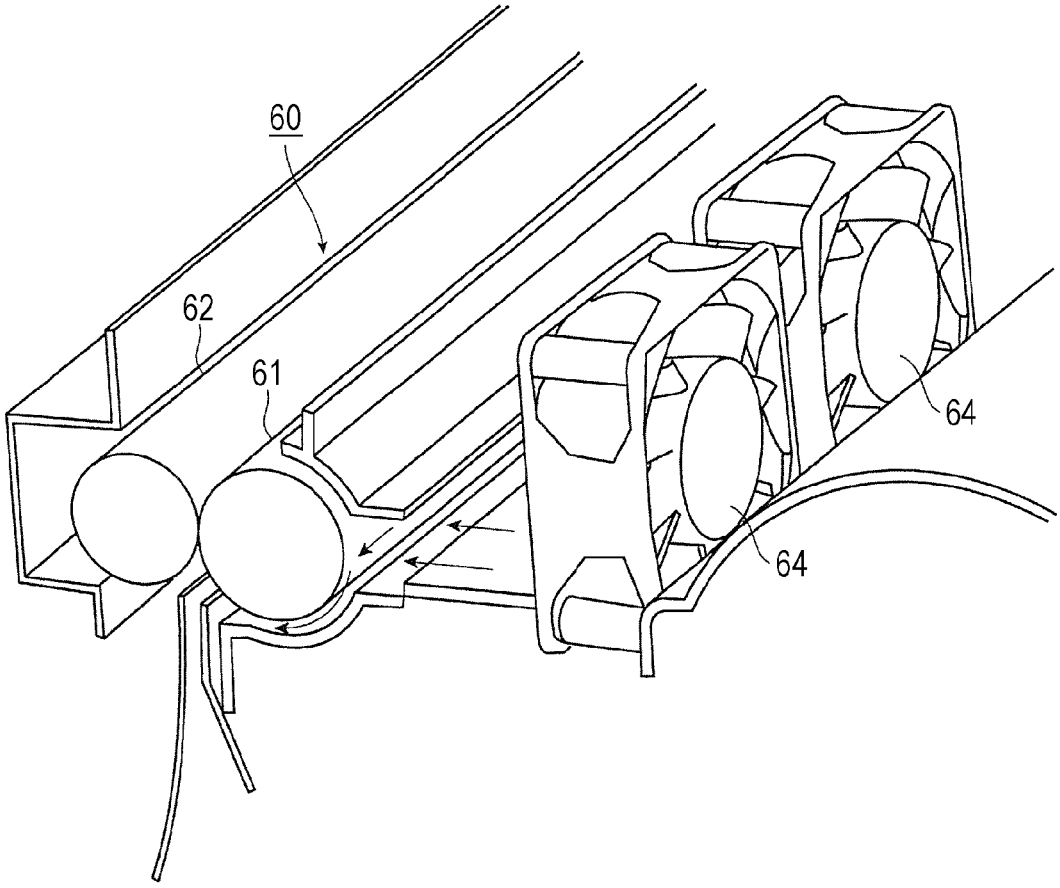
FIG. 4 is a perspective view illustrating the decurler according to the exemplary embodiment of the present invention.

As illustrated in FIG. 4, the decurler 60 further includes plural air-blowing fans 64, which are examples of an air-blowing unit. The air-blowing fans 64, which actively cool the decurling belt 61, are arranged in the longitudinal direction of the decurling belt 61. As illustrated in FIG. 3, the decurler 60 includes guide members 65 and 66, which guide air (airflow), blown from the air-blowing fans 64, in the circumferential direction of the decurling belt 61. The guide members 65 and 66 have an air inlet 67 facing toward the air-blowing fans 64. The guide members 65 and 66 are respectively disposed above and below the decurling belt 61 so as to cover substantially a half of the outer periphery of the decurling belt 61.

Figure 5:
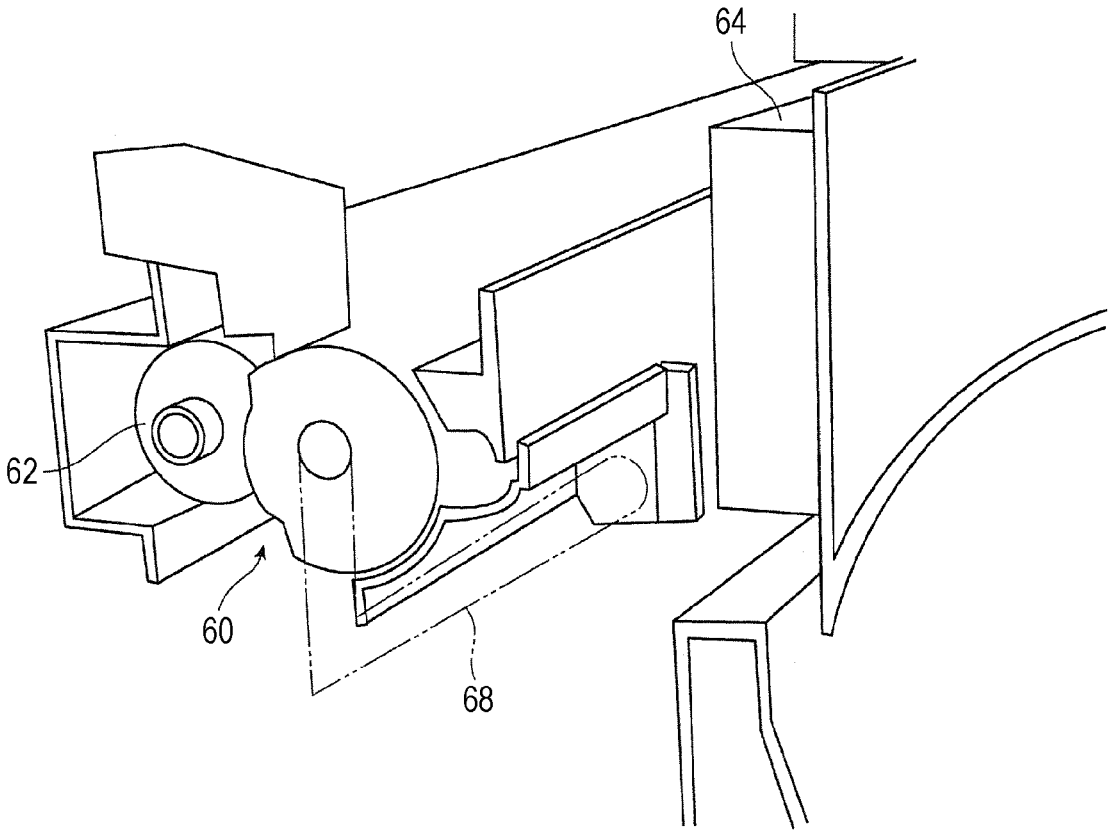
FIG. 5 is a perspective view illustrating the decurler according to the exemplary embodiment of the present invention.
Figure 6:
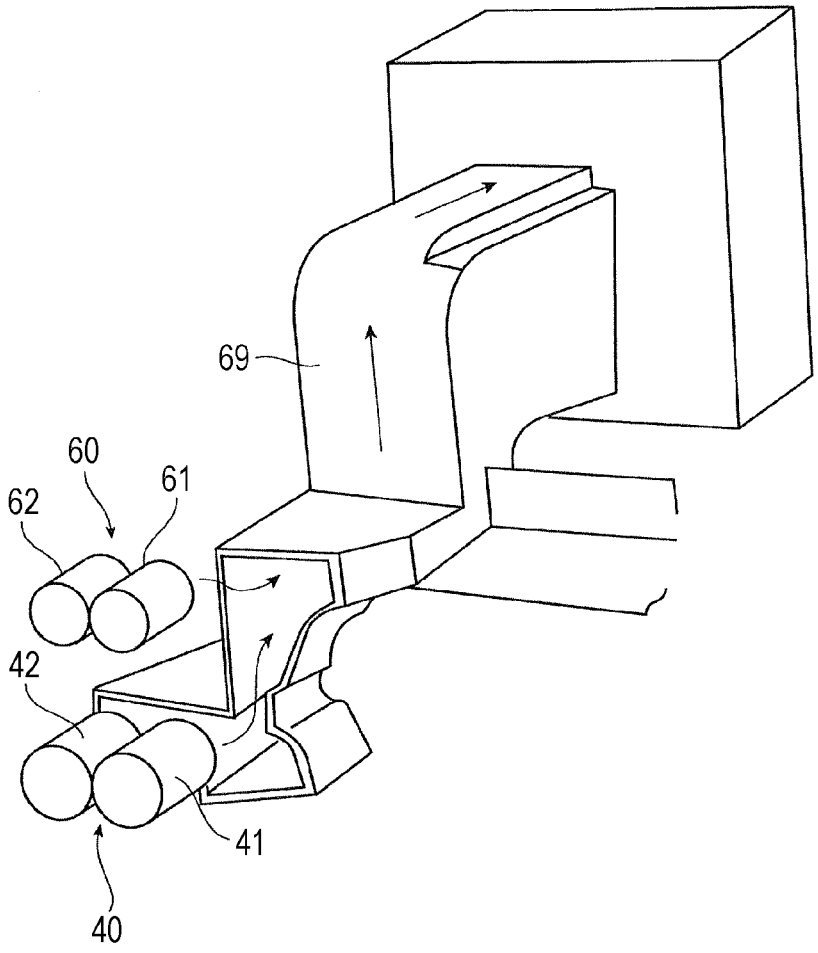
FIG. 6 is a perspective view illustrating the decurler according to the exemplary embodiment of the present invention.

As illustrated in FIG. 5, the decurler 60 further includes a duct 68, which guides airflow from the air-blowing fans 64 from one end of the decurling belt 61 in the longitudinal direction to the inside of the decurling belt 61. As illustrated in FIG. 6, heated airflow is discharged from the other end of the decurling belt 61 in the longitudinal direction, and the heated airflow is discharged through an exhaust duct 69 for discharging air around the fixing device 40 to the outside of the apparatus. The exhaust duct 69 is disposed in a back part of the image forming apparatus body 1*a*, and an exhaust fan (not shown) is driven when an image forming operation is started.

Operation of Decurler

The decurler 60 according to the present exemplary embodiment removes curl from the recording sheet 5 and cools the recording sheet 5 heated by the fixing device 40.

As illustrated in FIG. 1, the recording sheet 5 to which the toner image has been fixed by the fixing device 40 is transported in the image forming apparatus body 1*a* upward in the vertical direction and is guided into the decurler 60.

As illustrated in FIG. 3, in the decurler 60, in contrast to the fixing device 40, the decurling belt 61 is disposed so as to face an image surface of the recording sheet 5 to which the toner image T has been fixed, and the decurling roller 62 is disposed so as to face a surface of the recording sheet 5 on which an image is not formed.

Therefore, in a case where upward curl is generated in the recording sheet 5 when the recording sheet 5 passes through the fixing device 40 due to conditions, such as the structure of the fixing device 40, the material of the recording sheet 5, and the state of the toner image T on the recording sheet 5, downward curl tends to be generated in the recording sheet 5 when the recording sheet 5 passes through the decurler 60. As a result, when the recording sheet 5 passes through the decurler 60, the upward curl that has been generated in the fixing device 40 and the downward curl that is generated in the decurler 60 offset each other, and therefore curl of the recording sheet 5 is removed.

On the other hand, in a case where downward curl is generated in the recording sheet 5 when the recording sheet 5 passes through the fixing device 40, upward curl tends to be generated in the recording sheet 5 when the recording sheet 5 passes through the decurler 60. As a result, after the recording sheet 5 has passed through the decurler 60, curl has been removed from the recording sheet 5, because the downward curl generated in the fixing device 40 and the upward curl generated in the decurler 60 offset each other.

The recording sheet 5, which has been heated when passing through the fixing device 40, is actively cooled by airflow from the air-blowing fans 64 when passing through the decurler 60. Moreover, the holding member 632 and the support members 633 and 634, which support the decurling belt 61, are made of a thermally conductive synthetic resin having a thermal conductivity of 1 (W/mK) or higher. Therefore, heat from the decurling belt 61 is conducted to the holding member 632, which is in direct contact with the decurling belt 61; and to the support members 633 and 634, which indirectly contact the decurling belt 61 with the holding member 632 therebetween. As a result, the recording sheet 5 is effectively cooled. The thermally conductive synthetic resin has a thermal emissivity higher than that of metal, and has both high thermal conductivity and high thermal emissivity. Therefore, the holding member 632 and the support members 633 and 634, which are made of a thermally conductive synthetic resin, is capable of efficiently transmitting and radiating heat of the decurling belt 61, and is capable of efficiently cooling the decurling belt 61.

Example

The decurler 60 according to the present exemplary embodiment, which is illustrated in FIG. 3, is fabricated by the inventors. The effect of the decurler 60 according to the present exemplary embodiment is examined.

FIG. 7 illustrates the measurements of the curl amounts for upward curl and downward curl generated in the recording sheet 5 in a case where the decurler 60 according to the present exemplary embodiment of the invention is used and in a case where the decurler 60 according to the present invention is not used.

As is clearly seen from FIG. 7, in the case where the decurler 60 according to the present exemplary embodiment of the invention is used, it is possible to considerably reduce both the amount of upward curl and the amount of downward curl.

Figure 8:
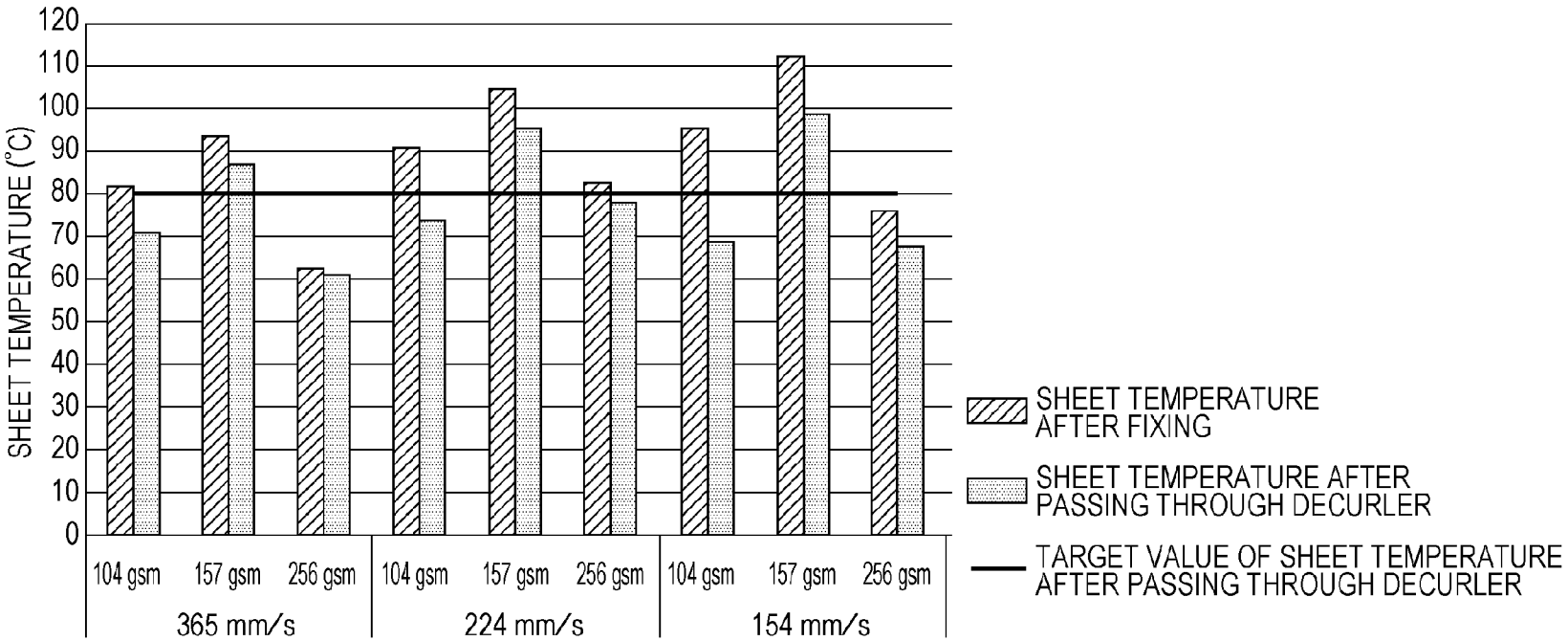
FIG. 8 shows a graph representing the results of Example.

FIG. 8 illustrates the measurements of the temperature of the recording sheet 5 after passing through the fixing device 40 and the temperature of the recording sheet 5 after passing through the decurler 60, which are measured in order to examine the cooling effect of the decurler 60.

As is clearly seen from FIG. 8, in the case where the decurler 60 according to the present exemplary embodiment of the invention is used, it is possible to make the temperature of the recording sheet 5, having a basis weight of either 104 gms or 256 gms, after passing through the decurler 60 be 80° C., which is a target value, or lower. Also for the recording sheet 5 having a basis weight of 157 gms, it is possible to effectively reduce the temperature of the recording sheet 5 after passing through the decurler 60.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A decurler comprising:

an endless decurling belt disposed to face an image surface of a recording medium on which an image is fixed;

a decurling roller configured to contact the decurling belt and configured to form a decurling region provided between the decurling roller and the decurling belt; and a support member made of a thermally conductive synthetic resin having a thermal conductivity of a range between 1 (W/mK) and 15 (W/mK) to remove heat from the recording medium and configured to directly or indirectly contact the decurling belt.

2. An image forming apparatus comprising:

an image forming unit configured to form a toner image on a recording medium;

a fixing unit configured to heat the toner image, the toner image formed on the recording medium by the image forming unit, and configured to fix the toner image to the recording sheet; and the decurler according to claim 1 configured to remove curl from the recording medium to which the toner image has been fixed by the fixing unit.

3. The decurler of claim 1, wherein the support member comprises a gap through which air flows through inside the support member along an axial direction of the decurler.

4. A decurler comprising:

an endless decurling belt disposed to face an image surface of a recording medium on which an image is fixed;

a decurling roller configured to contact the decurling belt and configured to form a decurling region provided between the decurling roller and the decurling belt; and a support member made of a thermally conductive synthetic resin having a thermal conductivity of a range between 1 (W/mK) and 15 (W/mK) to remove heat from the recording medium and configured to directly or indirectly contact the decurling belt, wherein the support member comprises:

a holding member configured to hold a pressing pad; and a holding member supporting member configured to support the holding member, and wherein the holding member is provided at an inner side of the decurling belt and is configured to contact the decurling belt at a position upstream of the decurling region in a rotating direction of the decurling belt.

5. An image forming apparatus comprising:

an image forming unit configured to form a toner image on a recording medium;

a fixing unit configured to heat the toner image, the toner image formed on the recording medium by the image forming unit, and configured to fix the toner image to the recording sheet; and the decurler according to claim 4 configured to remove curl from the recording medium to which the toner image has been fixed by the fixing unit.

* * * * *